US005183030A

United States Patent [19]

Woodward

[11] Patent Number: 5,183,030

[45] Date of Patent: Feb. 2, 1993

[54] HEARTH COMFORTER

[76] Inventor: Keile J. Woodward, 867 Joann Ct., Carmel, Ind. 46032

[21] Appl. No.: 803,512

[22] Filed: Dec. 9, 1991

[51] Int. Cl.[5] ..... F24B 1/18

[52] U.S. Cl. ..... 126/500; 126/544

[58] Field of Search ..... 126/500, 544, 546, 12; 52/3, 515, 288; 5/100, 512, 493

[56] References Cited

U.S. PATENT DOCUMENTS

| | | | |
|---|---|---|---|
| 2,324,031 | 7/1943 | Schiffenhaus | 206/453 X |
| 2,564,386 | 8/1951 | Webb . | |
| 2,995,863 | 8/1961 | Bright | 248/345.1 |
| 3,725,188 | 4/1973 | Kalt | 248/345.1 |
| 4,117,782 | 10/1978 | Cahill | 248/345.1 X |
| 4,153,230 | 5/1979 | Giacin | 248/345.1 |
| 4,443,903 | 4/1984 | Leitner | 5/459 |
| 4,514,870 | 5/1985 | Tyler, Jr. | 5/482 X |
| 4,623,571 | 11/1986 | Yamamoto et al. | 248/234 X |
| 4,787,366 | 11/1988 | Bell | 126/500 |
| 4,865,015 | 9/1989 | Hasty et al. | 126/500 |
| 4,867,135 | 9/1989 | Stecker | 126/500 |
| 4,903,686 | 2/1990 | Jenning | 126/500 |
| 4,922,891 | 5/1990 | King | 126/500 |
| 5,050,583 | 9/1991 | Chapek et al. | 126/500 |
| 5,058,566 | 10/1991 | Dabbs et al. | 126/500 |

*Primary Examiner*—Larry Jones
*Attorney, Agent, or Firm*—G. Brian Pingel

[57] ABSTRACT

An elongated hearth comforter having an interior of batting material and ends that are sewn together to provide increased cushioning. The comforter is designed to be an attractive decorative piece that partially covers the upward facing surface of a fireplace hearth.

4 Claims, 2 Drawing Sheets

HEARTH COMFORTER

BACKGROUND OF THE INVENTION

1. Field of the Invention

This invention relates to fireplace hearths, and more particularly to decorative coverings for fireplace hearths.

2. Description of the Prior Art

Protective coverings for articles of furniture are known. Protective coverings used to protect furniture edges from damage, especially When the furniture is being moved, are disclosed in U.S. Pat. Nos. 3,725,188, 2,995,863 and 2,324,031. The devices disclosed in these patents cover only a single triplanar corner of an article of furniture. The disclosed devices do not traverse the length of an edge of an article, nor do they simultaneously cover two triplanar corners.

U.S. Pat. No. 2,564,386 discloses a furniture cover that traverses an edge of an article of furniture. However, the device is directed primarily toward a structure for securing the cover to the furniture, and the device cannot cover a triplanar corner of an article.

Protective coverings that extend between a plurality of triplanar corners are disclosed in U.S. Pat. Nos. 4,153,230 and 4,117,782. Those coverings are kept in place by completely surrounding the article of furniture. Also, none of the above coverings has a fireplace hearth-engaging surface, has a fabric exterior, or has a non-smooth exterior.

A fire resistant blanket is disclosed in U.S. Pat. No. 4,514,870. Such blankets are made of fabric, but do not contain a shock absorbing interior. Fire resistant cushions are also known (e.g., U.S. Pat. No. 4,623,571) and are used as cushioning members for airplanes, ships, vehicles, and furniture. However, these cushions are not used to reduce the risk of injuries to persons from concussive forces and have not been applied to fireplace hearths. U.S. Pat. No. 4,443,903 discloses a process for making flame retardant fabrics, but does not disclose coverings that reduce the risk of concussive injury. U.S. Pat. No. 4,787,366 discloses a fireplace hearth safety device designed to cover the front face and edges of the hearth. However, such patent does not sit upon the hearth and is attached thereto by Velcro fasteners.

SUMMARY OF THE INVENTION

The present invention is a hearth comforter having an interior of shock absorbing material. The comforter's exterior is made of attractive fabric, which may enhance the decor of a room and is positioned upon the upper surface of a fireplace hearth to lessen the risk of injury to those falling against the hearth.

DETAILED DESCRIPTION OF THE PREFERRED EMBODIMENT

Figure 1:
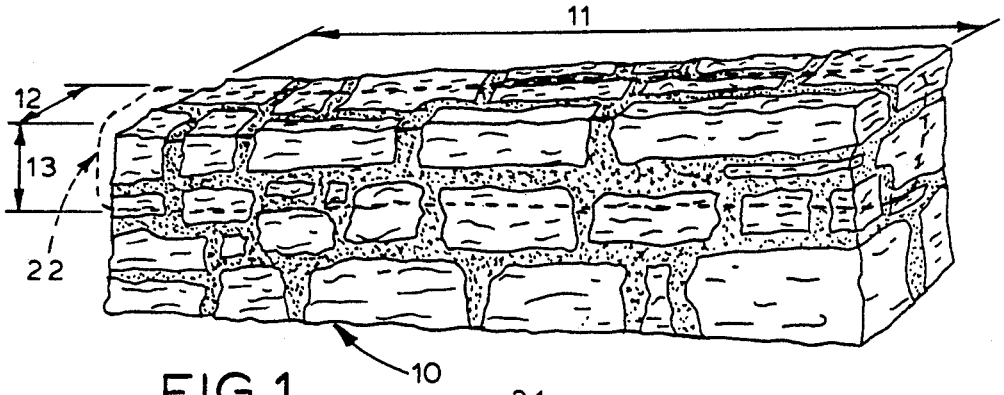
FIG. 1 is a perspective view showing the configuration of a fireplace hearth to be covered by a hearth comforter of the present invention.

The present invention may be illustrated by the preferred embodiment described below. FIG. 1 is a perspective view showing the dimensions of a fireplace hearth 10 to be covered by a hearth comforter of the invention. The length of the hearth is designated as 11, and upward facing top and outward facing front portions of the hearth are designated as 12 and 13, respectively.

Figure 2:
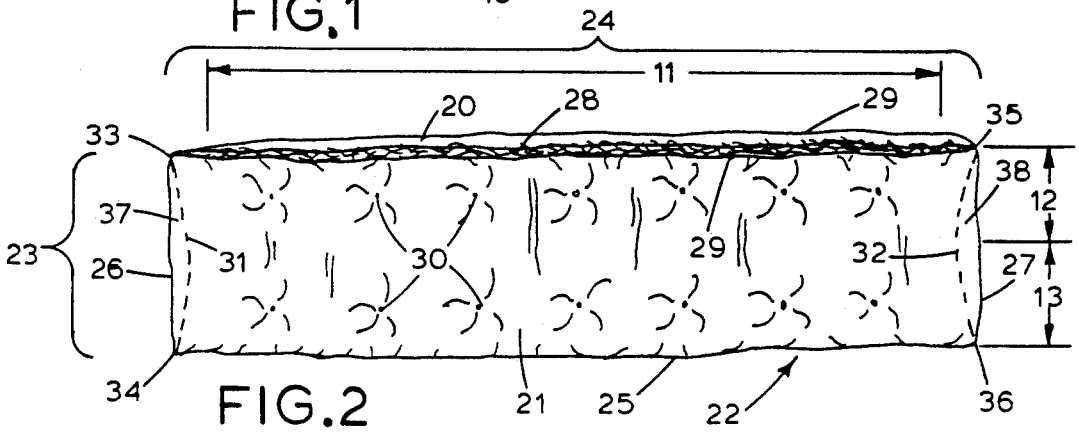
FIG. 2 is a view of two sheets of fabric used to construct a hearth comforter of the invention, showing broken stitch line locations to form the ends of the comforter.

FIG. 2 is a view of two equally-sized, rectangular sheets of fabric 20 and 21, used to construct a hearth comforter 22 of the invention. The sheets 20 and 21 are made preferably of Palencia Broadcloth manufactured by Spring Mills in North Carolina. The first sheet 20 serves to form the front exterior of the comforter 22, and such sheet may include a decorative pattern to match the decor of the room in which the comforter 22 is to be placed. The second sheet 21 serves to form the rear exterior of the comforter. The dimensions of the fabric sheets 20 and 21 are determined by the size of the particular fireplace hearth 10 on which the comforter 22 will be placed.

Figure 4:
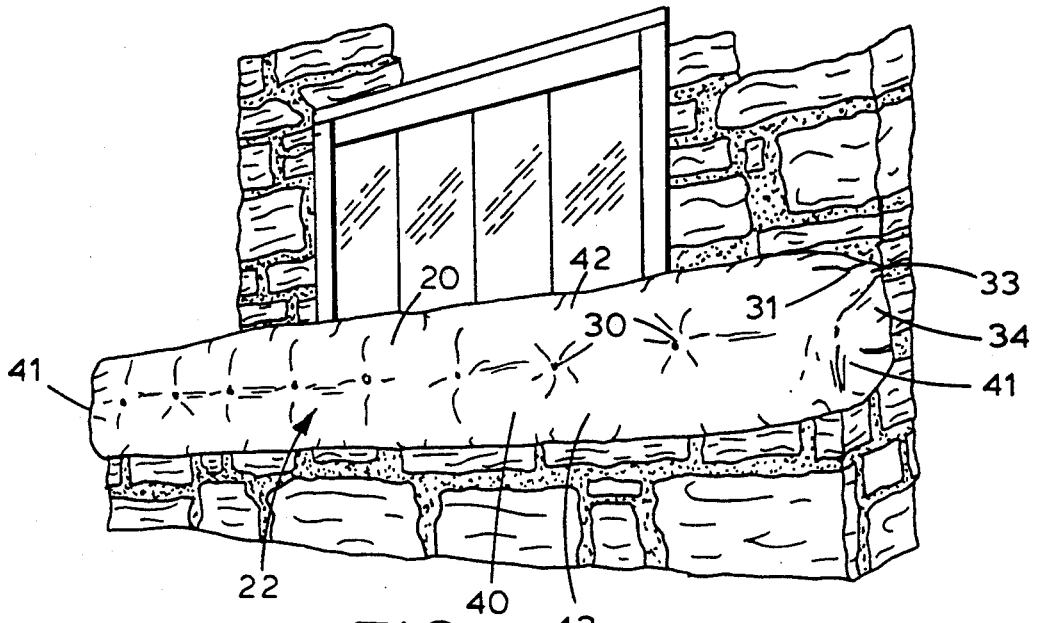
FIG. 4 is a front view of the hearth comforter of the invention positioned upon a fireplace hearth.

The comforter 22 preferably will cover both the top and front portions 12 and 13 respectively of the hearth 10. Thus, the fabric sheets 20 and 21 should each have a width 23 equal to the sum of the widths of the hearth top and front portions 12 and 13 respectively, and such sheets should have a length 24 (FIG. 2) great enough so that the comforter will hang over the ends of the hearth 10 as shown in FIG. 4. In the preferred embodiment, length 24 is approximately 14 inches greater than hearth length 11 (FIGS. 1 and 2).

The fabric sheets 20 and 21 are overlaid and sewn together along their bottom edges 25 and side edges 26 and 27 to form an envelope, which may then be filled with a batting that is preferably shock-absorbing material 28 (FIG. 2). The fabric sheets 20 and 21 may also be a single sheet of fabric which is folded together to form the bottom edge 25 and then the side edges 26 and 27 may then be sewn together to form an envelope.

In the preferred embodiment, the shock-absorbing material 28 is Mountain Mist batting from Sterns and Foster in Cincinnati, Ohio. Top edges 29 of the sheets 20 and 21 are then sewn together, enclosing the shock-absorbing material 28. At periodic locations such as 30 in FIG. 2, yarn may be used to stitch the opposing sheets 20 and 21 together to assist in maintaining an even distribution of the material 28 within the comforter 22.

Figure 3:
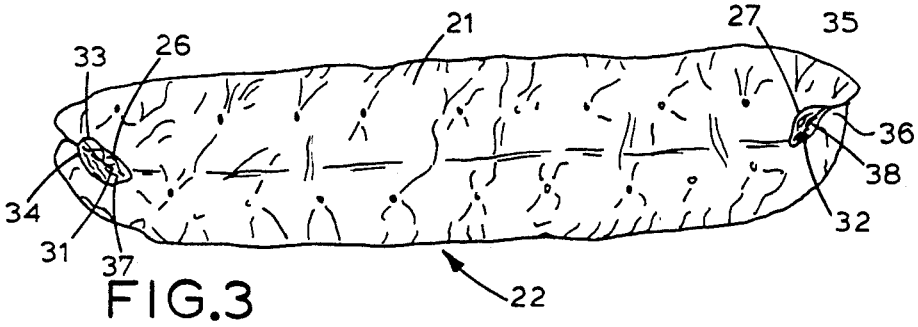
FIG. 3 is a rear view of the hearth comforter of the invention.

As further shown in FIG. 2, broken stitch lines 31 and 32 designate the locations of the upper and lower portions of fabric sheets 20 and 21 that are sewn together to form ends 41 shown in FIG. 4. Adjacent corners 33 and 34 (and 35 and 36) of the sheets 20 and 21 are brought proximate to one another and the upper and lower portions of fabric sheets 20 and 21 are then sewn together along the stitch lines 31 and 32 to form ends 41 shown in FIG. 4. Triangular shaped sections, 37 and 38 (FIG. 3), formed by the side edges 26 and 27 (FIG. 2) and stitch lines 31 and 32, protrude from the rear surface 21 and increase the thickness of the comforter at its opposing triplanar corners, thus providing additional cushioning for a portion of the sides of the fireplace hearth 10.

FIG. 4 is a view of the hearth comforter 22 of the invention supported on the fireplace hearth 10 with a body portion 40 of the comforter substantially covering the entire top portion 12 of the hearth 10. The showing of the comforter 22 in FIG. 4 is reversed from the showing of FIG. 3. It may be appreciated that the comforter body 40 includes a top portion 42, a front portion 43, and two end portions 41. Top portion 42 is generally perpendicular to front portion 43, and each end portion 41 is generally perpendicular to both the front portion 43 and the top portion 42.

The above construction provides a hearth comforter, that may be economically constructed from a single lamination of opposing fabric sheets. However, it is contemplated that the comforter of the present invention could also be easily constructed using separate end portions 41 sewn to the top portion 42 and front portion 43 of the comforter. Also, the above constructions provides a hearth comforter having a non-smooth fabric exterior, which provides an aesthetically pleasing visual effect when placed on a fireplace hearth.

Means other than stitching with yarn at 30 (FIG. 4) may also be used for maintaining an even distribution of shock-absorbing material within the hearth comforter (for example, stitching with thread or stapling). Stitching the batting between the sheets 20 and 21 along the bottom edge 25 (FIG. 2) and the side edges 26 and 27 also aids in maintaining the batting. The above fabric sheets 20 and 21 are not flame retardant. However, such fabric may be flame retardant, such as flannel made by Guildford Mills (a subsidiary of Travis Knits, 200 Madison Avenue, New York, N.Y. 10016). Also, fabrics may be made flame retardant by a process such as the process disclosed in U.S. Pat. No. 4,443,903.

Many changes can be made in the above procedures and many different embodiments of this invention can be made without departing from the scope thereof, and it is intended that all matter contained in the above description or shown in the accompanying drawings shall be interpreted as illustrative and not in a limiting sense.

I claim:

1. A hearth comforter for placement upon an upward facing surface of a fireplace hearth, said comforter comprising:

(a) a substantially rectangularly shaped body including front and rear sheets having side, top and bottom edges fastened together to form an enclosure;

(b) a batting material enclosed within said body;

(c) said body has opposite ends, each having adjacent corners that are brought proximately together and attached to one another to form end portions of an increased thickness to provide additional cushioning at the ends of the comforter which overlap the corners of the fireplace hearth;

(d) said body is primarily supported upon said hearth by at least a portion of said upward facing surface;

(e) said body has a length greater than that of said hearth such that said body overhangs at least a portion of the upward facing surface at its ends; and (f) said body has a width sized so that a substantial amount of said upward facing surface of the hearth is covered by said comforter and also so that said body overhangs at least a portion of the front side of said hearth.

2. A hearth comforter as recited in claim 1 wherein said adjacent corners of said body are attached together along stitch lines such that each end portion has a triangular shaped section formed by one of the end side edges of the body and the associated stitch line therewith.

3. A hearth comforter as recited in claim 1 wherein said batting material is shock absorbing and said comforter further includes means for maintaining an even distribution of said shock absorbing material within said body.

4. A hearth comforter as recited in claim 1 wherein said body overhangs the front side and end edges of said upward facing surface of said hearth.

* * * * *